United States Patent [19]

Leighton

[11] Patent Number: 4,563,817

[45] Date of Patent: Jan. 14, 1986

[54] CHAIN SAW SLACK ADJUSTER

[76] Inventor: Dawson N. Leighton, Rte. 3, Box 332, Dover, Fla. 33527

[21] Appl. No.: 512,106

[22] Filed: Jul. 7, 1983

[51] Int. Cl.[4] ..... B27B 17/02; B27B 17/14

[52] U.S. Cl. ..... 30/386; 83/814; 474/111

[58] Field of Search ..... 30/386; 83/816, 814; 254/108, 109; 198/813; 474/111, 136, 101; 188/196 B

[56] References Cited

U.S. PATENT DOCUMENTS 2,624,379 1/1953 Arneson .

FOREIGN PATENT DOCUMENTS 690684 7/1964 Canada ..... 474/111

*Primary Examiner*—Douglas D. Watts

*Attorney, Agent, or Firm*—Harvey B. Jacobson

[57] ABSTRACT

One side of the base end of a chain saw bar and an opposing abutment member relative to which the base end of the saw bar is releasably clamped include ratchet and pawl structure operative, when the clamping action between the abutment member and the saw bar base end is relaxed, to allow lengthwise saw chain tightening adjustment of the saw bar in a first direction and to prevent lengthwise displacement of the saw bar relative to the abutment member in the opposite direction.

7 Claims, 7 Drawing Figures

FIG. 1
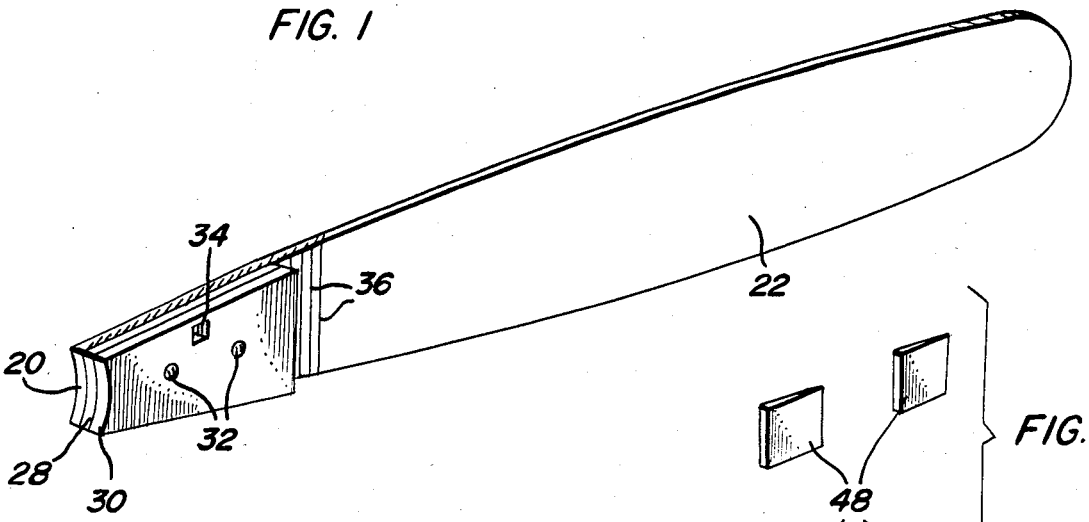
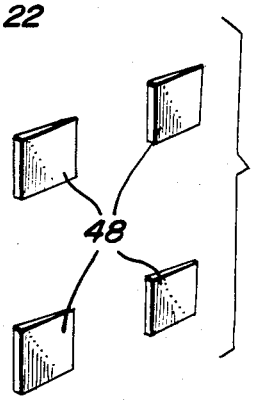
FIG. 4
FIG. 2
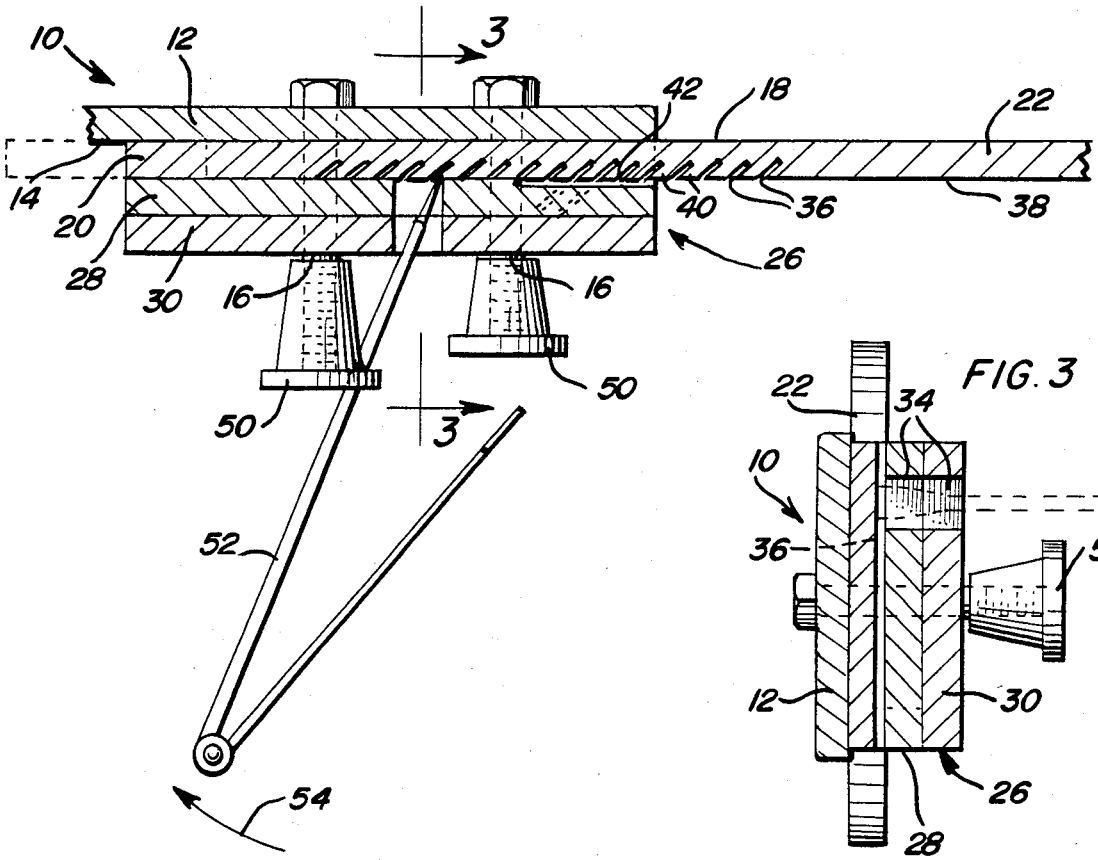
FIG. 3

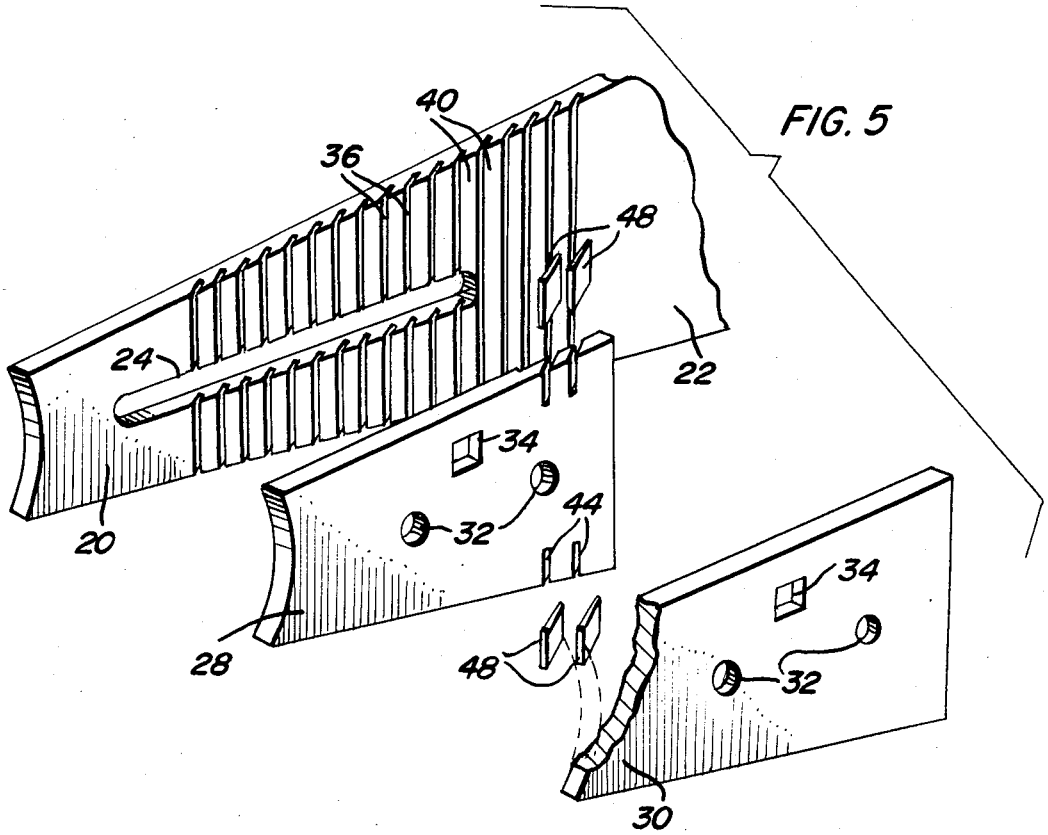
FIG. 5
FIG. 7
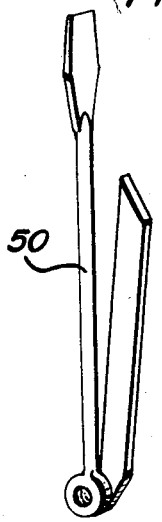
FIG. 6
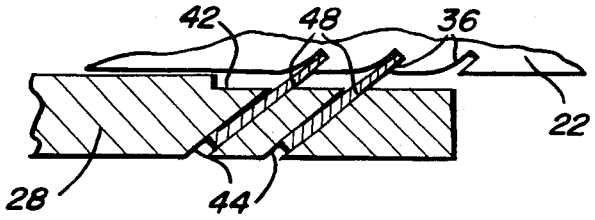

CHAIN SAW SLACK ADJUSTER

BACKGROUND OF THE INVENTION

Various forms of chain saw bar adjusting mechanisms for lengthwise adjusting a chain saw bar in order to properly tension the associated saw chain heretofore have been provided. Examples of various forms of bar adjusting mechanisms including some of the general structural and operational features of the instant invention are disclosed in U.S. Pat. Nos. 2,624,379, 2,765,821, 2,839,097, 2,910,099, 3,636,995 and 4,129,943.

However, most of these previously known forms of chain saw bar adjusting mechanisms are subject to malfunction if the clamp screws or bolts for the chain saw bar become partially loosened as a result of chain saw vibration. Accordingly, a need exists for an improved form of chain saw bar adjusting mechanism which will be operative to maintain chain saw bar adjustment and to withstand chain saw vibration without damage in the event of partial loosening of the chain saw bar adjustment clamping screws or bolts.

BRIEF DESCRIPTION OF THE INVENTION

The saw chain slack adjuster of the instant invention incorporates ratchet and pawl structure carried by one side of the base end of an associated chain saw bar and the opposing side of a clamping plate. The ratchet and pawl structure enables ready lengthwise adjustment of the bar in predetermined increments in one direction when the clamping screws or bolts of the saw bar are partially loosened and prevents lengthwise displacement of the bar in the opposite direction. The ratchet and pawl structure incorporates transversely extending and longitudinally spaced ratchet teeth carried by one side of the base end of the saw bar and a clamp plate opposing that side of the base end of the saw bar and including resilient pawl members carried by the clamp plate and engaged with the saw bar teeth, the latter facing toward the free end of the bar base end.

The main object of this invention is to provide a saw bar adjustment structure which will enable predetermined increments of longitudinal displacement of a saw bar in a direction to tension the associated chain.

Another object of this invention provide adjustment structure that will be operative to prevent lengthwise displacement of an associated saw bar in a direction to loosen an associated chain while the saw bar clamping bolts or screws are at least partially tightened.

Still another important object of this invention is to provide a chain saw bar adjustment structure which will be capable of reliable performance even when the associated saw bar clamping screws are partially loosened due to chain saw vibration.

A final object of this invention to be specifically enumerated herein is to provide a chain saw bar adjustment structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a saw bar and clamp plate constructed in accordance with the present invention;

FIG. 2 is a fragmentary sectional view illustrating the manner in which the saw bar and clamp plate may be operatively mounted relative to a chain saw bar mounting flange;

FIG. 3 is a vertical sectional view taken substantially upon the plane indicated by the section line 3—3 of FIG. 2;

FIG. 4 is a perspective view of the four pawl elements of the ratchet and pawl structure incorporated in the instant invention;

FIG. 5 is a fragmentary exploded perspective view of the bar and clamp plate structure of the instant invention;

FIG. 6 is a fragmentary horizontal sectional view illustrating the manner in which pawl structure is mounted relative to the supportive clamp plate structure therefore; and FIG. 7 is a perspective view of a lever-type tool which may be used in conjunction with the ratchet and pawl structure of the instant invention in order to effectively incrementally longitudinally adjust the associated chain saw bar.

DETAILED DESCRIPTION OF THE INVENTION

Referring now more specifically to the drawings, the numeral 10 generally designates a typical chain saw structure incorporating a chain saw bar mounting flange 12 including a first side 14 thereof outwardly from which a pair of threaded shank members 16 project and against which one side 18 of the base end 20 of a saw bar 22 is to be abutted and clamped. The saw bar base end 20 includes a longitudinal slot 24 formed therein as is conventional and the threaded shank members 16 project through the slot 24.

Conventionally, the saw bar 22 is abutted against the mounting flange 12 in the manner illustrated in FIG. 2 of the drawings and a clamp plate structure such as that referred to in generally by reference numeral 26 is clampingly secured thereover. The usual clamp plate structure is of one-piece construction. However, the clamp plate structure 26 includes first and second plates 28 and 30 each provided with a pair of transverse bores 32 formed therein and each provided with a window opening 34 therein. The bores 32 receive the threaded shank members 16 therethrough.

The bar 22 is provided with transversely extending and longitudinally spaced slots or grooves 36 on the second side 38 thereof which opposes the plate 28 and the slots or grooves 36 define ratchet teeth 40 therebetween facing toward the base end 20 of the bar 22. The plate 28 is relieved as at 42 on the side thereof which opposes the second side 38 of the bar 22 and relieved marginal edge portion of the plate 28 includes two longitudinally extending rows of transversely extending slots 44 formed therein. Each row of slots 44 includes two slots and each slot 44 has a resilient pawl blade 48 disposed therein. The pawl blades 48 taper toward the ends thereof which project into the relieved area 42 and the remote ends of the pawl blades 48 abut against the opposing side of the plate 30. If the slots 44 included closed inner ends, the plate 30 need not be used.

As may best be seen from FIG. 6 of the drawings, the tapered free ends of the pawl blades 48 are receivable in the slots or grooves 36 to prevent rearward displacement of the saw blade 22 when thumb nuts 50 threaded on the free ends of the shank member 16 are partially tightened. A lever tool 52 may be inserted through the window openings 34 and engaged with the slots or grooves 36 rearward of those slots and grooves in which the pawl blades 48 are engaged and swung in the direction of the arrow 54 in FIG. 2 in order to longitudinally advance the saw bar 22 toward the right as viewed in FIG. 2 of the drawings whereby an associated saw chain (not shown) will be tensioned. If it is desired to retract the saw bar 22 in order to remove the associated chain, it is necessary the thumb nuts 50 be substantially loosened in order that the clamp plate structure 26 may be displaced away from the second side 38 of the saw bar 22 sufficiently to withdraw the pawl blades 48 from the slots or grooves 36. However, when the thumb nuts 50 are at least partially tightened, rearward retractive displacement of the saw bar 22 is prevented by engagement of the pawl blades 48 in the slots or grooves 36.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated chain saw bar including a base end provided with at least one elongated longitudinal slot and adapted to be mounted in adjusted longitudinally shifted position relative to a chain saw bar mounting flange including a pair of threaded shank means projecting outwardly from one side thereof against which a first side of said base end is to be abutted and clamped in adjusted shifted position relative to said flange with said threaded shank means projecting through said slot, the other side of said base end including means defining transversely extending and longitudinally spaced ratchet teeth facing toward the free end of said base end, a clamp plate including apertures formed therein for snugly receiving said shank means therethrough with said clamp plate overlying said other side of said base end, a pair of threaded nut means for threading on said shank means on the side of said clamp plate remote from said base end, and resilient inclined pawl blade structure carried by said clamp plate and engaged with said ratchet teeth.

2. The saw bar of claim 1 wherein said clamp plate includes a window therein registered with said ratchet teeth through which an elongated lever tool may be inserted and engaged with said ratchet teeth in order to longitudinally advance said bar in a chain tightening direction relative to said clamp plate when said nut means are partially loosened.

3. The saw bar of claim 1 wherein said slot extends generally along a longitudinal center line of said bar and said teeth include end portions disposed on opposite sides of said center line, said clamp plate including resilient pawl blade structure also disposed on opposite sides of said longitudinal center line and engaged with opposite end portions of said teeth.

4. The saw bar of claim 1 wherein the side of said clamp plate from which said pawl blade structure projects is relieved to provide space for said pawl blade structure to flex.

5. The saw bar of claim 1 wherein said clamp plate comprises first and second superposed plate members with one of said plate members opposing said other side of said base end of said saw bar, said one plate member having inclined slots formed therethrough, said resilient inclined pawl blade structure comprising resilient blade members disposed in said slots, projecting outwardly of the ends of said slots opening toward said saw bar and abutted against the side of the other plate member opposing said one plate member.

6. A chain saw including a chain saw bar mounting flange having a pair of threaded shank means projecting outwardly from one side thereof, an elongated chain saw bar including a base end provided with at least one elongated longitudinal slot and overlying said one side of said mounting flange with said shank means slidably received through said slot, clamp plate structure overlying the side of said base end remote from said mounting flange and having openings formed therein through which said shank means are received, threaded nut means engaged with said shank means for clamping said base end between said clamp plate structure and mounting flange, the opposing sides of said clamp plate structure and base end including coacting ratchet and pawl means preventing longitudinal displacement of said chain bar relative to said mounting flange in a direction in which said base end faces and allowing longitudinal, displacement of said saw bar in the opposite direction relative to said mounting flange when said threaded nut means are partially loosened.

7. The chain saw of claim 6 wherein said base end and clamp plate structure include coacting ratchet and pawl means disposed on opposite side of said slot.

* * * * *